US007793602B2

(12) United States Patent
Koemer

(10) Patent No.: US 7,793,602 B2
(45) **Date of Patent: *Sep. 14, 2010**

(54) STITCHING METHOD AND APPARATUS EMPLOYING THREAD LONGITUDINAL MOVEMENT DETECTION

(76) Inventor: Ralph J. Koemer, P.O. Box 1320, Ramona, CA (US) 92065

( * ) Notice: Subject to any disclaimer, the term of this patent is extended or adjusted under 35 U.S.C. 154(b) by 596 days.

This patent is subject to a terminal disclaimer.

(21) Appl. No.: 11/818,124

(22) Filed: Jun. 13, 2007

(65) Prior Publication Data

US 2007/0256619 A1 Nov. 8, 2007

Related U.S. Application Data

(63) Continuation-in-part of application No. 11/443,563, filed on May 31, 2006, now Pat. No. 7,210,417, which is a continuation of application No. PCT/US2005/046830, filed on Dec. 21, 2005.

(60) Provisional application No. 60/638,959, filed on Dec. 24, 2004, provisional application No. 60/842,752, filed on Sep. 7, 2006.

(51) Int. Cl.
*D05B 51/00* (2006.01)

(52) U.S. Cl. ..... 112/278

(58) Field of Classification Search ..... 112/278, 112/61.16, 273, 559.4, 559.43
See application file for complete search history.

(56) References Cited

U.S. PATENT DOCUMENTS

| | | | | |
|---|---|---|---|---|
| 5,103,750 | A * | 4/1992 | Sato et al. | 112/278 |
| 5,651,324 | A * | 7/1997 | Arnold | 112/278 |
| 6,564,733 | B2 * | 5/2003 | Butzen et al. | 112/273 |
| 6,810,824 | B2 * | 11/2004 | Durville | 112/278 |
| 6,863,007 | B2 * | 3/2005 | Fluckiger | 112/475.01 |

* cited by examiner

*Primary Examiner*—Danny Worrell
(74) *Attorney, Agent, or Firm*—Freilich, Hornbaker & Rosen

(57) ABSTRACT

A method and apparatus for detecting longitudinal thread motion in a quilting/sewing machine for controlling the actuation of a fixedly located stitch head. A preferred detector comprises an optical sensor which directly senses the longitudinal movement of a thread as it moves along a guide path from a supply source toward a stitch head needle.

9 Claims, 12 Drawing Sheets

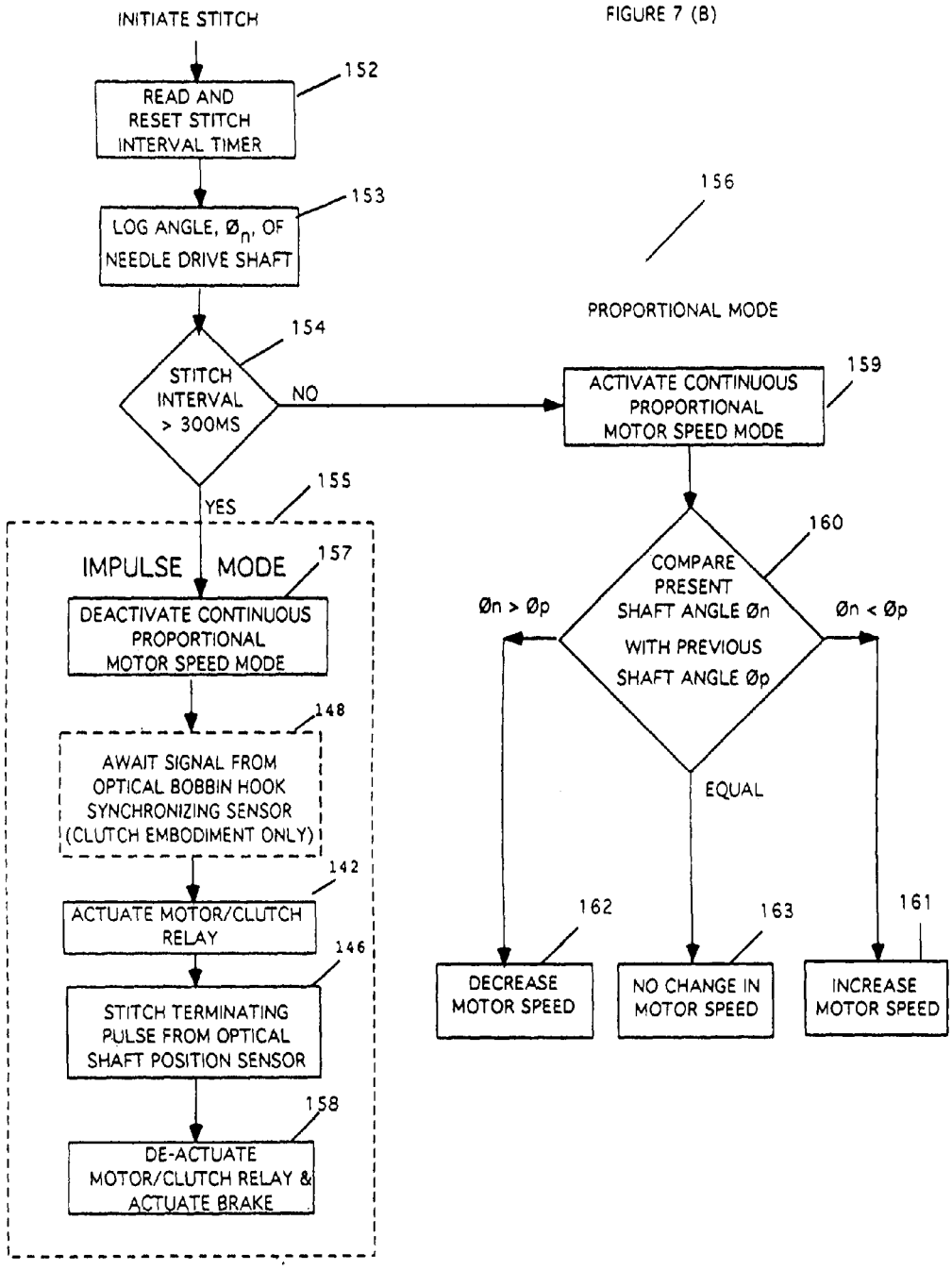
FIGURE 7 (B)
INITIATE STITCH
152
READ AND RESET STITCH INTERVAL TIMER
153
LOG ANGLE, Ø$_n$, OF NEEDLE DRIVE SHAFT
154
STITCH INTERVAL > 300MS
NO
YES
155
IMPULSE MODE
157
DEACTIVATE CONTINUOUS PROPORTIONAL MOTOR SPEED MODE
148
AWAIT SIGNAL FROM OPTICAL BOBBIN HOOK SYNCHRONIZING SENSOR (CLUTCH EMBODIMENT ONLY)
142
ACTUATE MOTOR/CLUTCH RELAY
146
STITCH TERMINATING PULSE FROM OPTICAL SHAFT POSITION SENSOR
158
DE-ACTUATE MOTOR/CLUTCH RELAY & ACTUATE BRAKE
156
PROPORTIONAL MODE
159
ACTIVATE CONTINUOUS PROPORTIONAL MOTOR SPEED MODE
160
COMPARE PRESENT SHAFT ANGLE Øn WITH PREVIOUS SHAFT ANGLE Øp
Øn > Øp
Øn < Øp
EQUAL
162
DECREASE MOTOR SPEED
163
NO CHANGE IN MOTOR SPEED
161
INCREASE MOTOR SPEED

STITCHING METHOD AND APPARATUS EMPLOYING THREAD LONGITUDINAL MOVEMENT DETECTION

RELATED APPLICATIONS

This application claims priority based on US Provisional Application 60/842,752 filed 7 Sep. 2006 (now U.S. Pat. No. 7,210,417) which is a continuation in part of U.S. application Ser. No. 11/443,563 filed on 31 May 2006 which is a continuation of PCT Application PCT/US 2005/046830 filed on 21 Dec. 2005 which claims priority based on U.S. Provisional Application 60/638,959 filed on 24 Dec. 2004. This application claims priority based on all the aforecited applications which are incorporated herein by reference.

FIELD OF THE INVENTION

This invention relates generally to improvements in sewing machines and more particularly to a method and apparatus for producing uniform length stitches in a stack of fabric layers while allowing a user to manually guide the stack across a planar surface beneath a stitch head.

BACKGROUND OF THE INVENTION

Applicant's U.S. Pat. No. 6,883,446 issued on 26 Apr. 2005 describes an apparatus which permits a user to manually move a stack of fabric layers across a planar bed beneath a stitch head. The apparatus includes a detector for detecting the movement of the stack for the purpose of synchronizing the delivery of stitches to the stack movement. This approach enables the insertion of uniform length stitches while allowing the user to freely move the stack within a wide range of speeds, to start or stop the stack movement at will, and to guide the stack in any direction across the planar bed.

The preferred embodiments described in said U.S. Pat. No. 6,883,446 employ a detector configured to detect stack movement within the throat space of a quilting/sewing machine by measuring the movement of at least one surface of the stack as it moves across the planar bed. As described, a preferred detector responds to energy, e.g., light, reflected from a target area on the stack surface (top and/or bottom) within the machine's throat space. The detector preferably provides output pulses representative of incremental translational movement of the stack along perpendicular X and Y directions. The output pulses are then processed and used to control the stitch head actuation rate.

Applicant's U.S. Pat. No. 6,883,446 primarily contemplates that a user directly grasp, or touch, the stacked fabric layers to push and/or pull the stack across the planar bed. However, the application also recognizes that the user could, alternatively, mount the stack on a quilt frame and then grasp the frame to move the stack across the planar bed to enable the detector to sense stack surface movement.

Applicant's U.S. Application 60/571,109 filed 14 May 2004, which is incorporated herein by reference, describes alternative embodiments for controlling stitch head actuation which involve using a frame for mounting the fabric layer stack. The frame is supported for user guided movement beneath a fixedly located stitch head and a detector is provided to produce signals representing the magnitude of frame translation, and thus the magnitude of stack translation.

Applicant's parent application Ser. No. 11/443,563 describes a further method and apparatus for controlling stitch head actuation as a function of stack movement based on the recognition that thread is pulled, or paid out, from a top or bottom bobbin, or spool, in direct relationship to the movement of the stack. By detecting the longitudinal movement of the thread, control circuitry can respond to control the rate of stitch head actuation. As a consequence, uniform length stitches can be produced as the stack is freely manually guided across the planar bed.

The thread payout detector embodiments described in said application Ser. No. 11/443,563 rely primarily upon sensing the rotation of a mechanical member, e.g., an encoder carried by a thread supply spool (FIG. 8) or a thread driven gear (FIG. 14A). Although such embodiments can function satisfactorily under some circumstances, various mechanical factors can adversely affect their performance; e.g., slippage between the thread and rotating member, potential contact damage to the thread, increased thread drag, etc. One detector embodiment (FIG. 11) described in said application Ser. No. 11/443,563 avoids physical contact with the thread by employing an optical sensor for detecting uniformly spaced features of the thread.

SUMMARY OF THE INVENTION

The present invention is directed to an enhanced method and apparatus for detecting longitudinal thread movement in a quilting/sewing machine for controlling the actuation of a fixedly located stitch head.

A preferred detector in accordance with the invention is comprised of an optical sensor which directly senses the longitudinal movement of a thread as it moves along a defined guide path from a thread supply source toward a stitch head needle. The preferred detector includes, means for guiding the thread along a path close to the focus of the optical sensor and a light source which illuminates the thread on the guide path to reflect light therefrom onto the optical sensor for producing an electric output signal representative of longitudinal thread movement.

The guide path is preferably formed as an elongate V-shaped channel in a base plate. A hold-down plate carrying an elongate V-shaped protuberance is provided for nesting the protuberance in the channel to form a small elongate passageway therebetween. The passageway is preferably dimensioned to allow a thread to readily move longitudinally therethrough while avoiding lateral slack in the thread. A transparent window is provided in the channel for enabling the light source to illuminate the thread and for collecting light reflected therefrom for application to the optical sensor.

BRIEF DESCRIPTION OF THE FIGURES

FIG. 1 is a generalized block diagram depicting a system for fastening stacked planar layers;

FIG. 2 is a diagrammatic illustration of an embodiment of the system of FIG. 1 utilizing a motor/brake assembly to control a stitch head in response to movement of a stack of fabric layers;

FIG. 3 is a diagrammatic illustration showing the stitch needle and hold-down plate of FIG. 2 in their down position;

FIG. 4 is a diagrammatic illustration similar to FIG. 3 but showing the needle and hold-down plate in their up position;

FIGS. 5 and 6 respectively show side and end views of an exemplary quilting/sewing machine housing;

FIG. 7 (presented as 7A and 7B) comprises a flow chart depicting dual mode operation, i.e., (1) impulse mode and (2) proportional mode;

DETAILED DESCRIPTION

Figure 1:
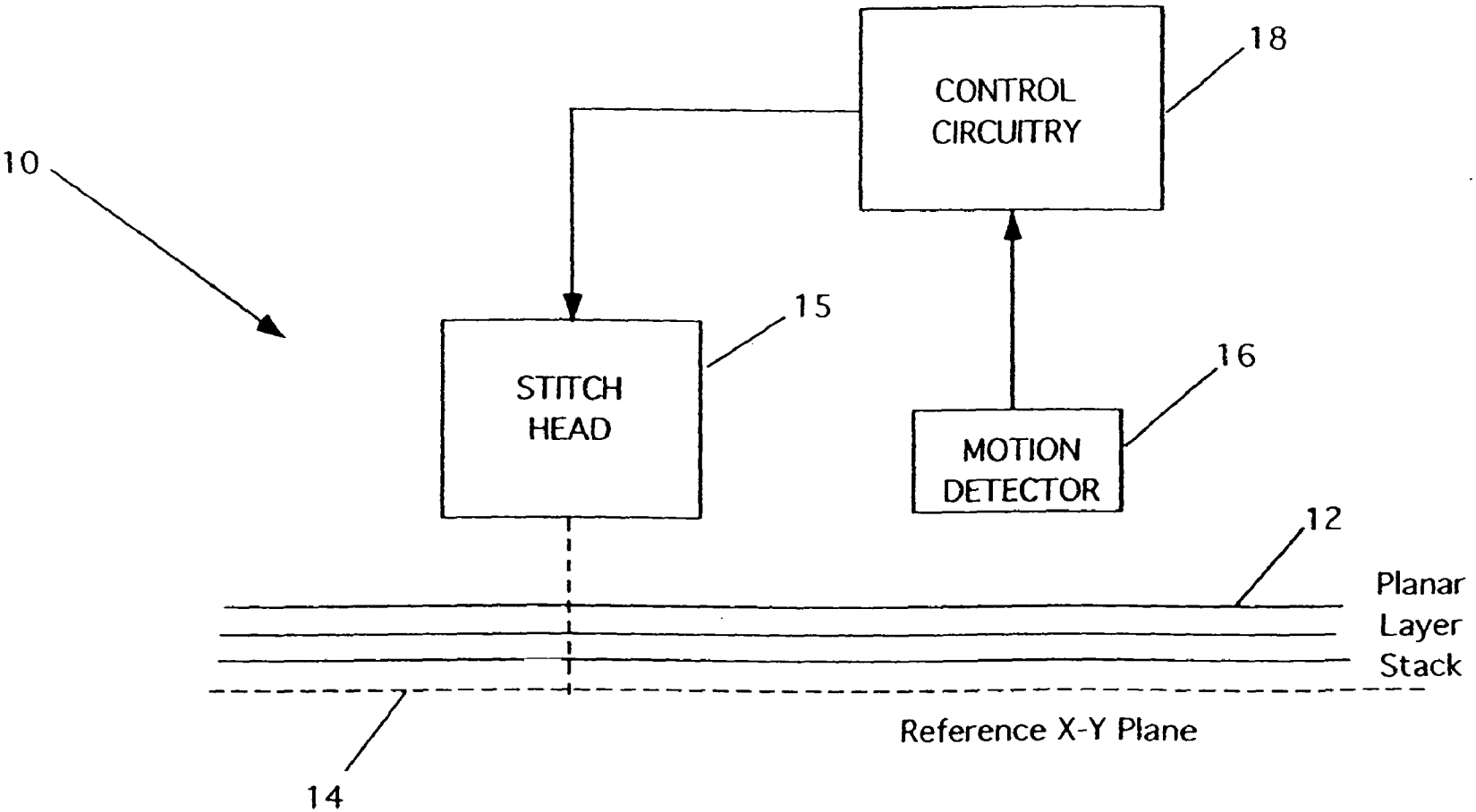
FIGS. 1-7 herein correspond to figures in parent application Ser. No. 11/443,563.

U.S. application Ser. No. 10/776,355 (now U.S. Pat. No. 6,883,446) and U.S. application Ser. No. 11/443,563 are incorporated herein by reference. However, for convenience sake, several of the figures and related text from these applications are expressly reproduced in this application, e.g., FIGS. 1-6, and 7(A), 7(B) of application Ser. No. 11/443,563 which respectively correspond to FIGS. 1-6, and 11(A), 11(B) of said '355 application. FIGS. 8-15 herein are first being introduced in this application Attention is initially directed to FIG. 1 which depicts a generalized system 10, as shown in said '355 application, for fastening together two or more fabric layers forming a stack 12. The stack 12 is supported for guided free motion along a horizontally oriented X-Y planar surface 14 proximate to a stitch head 15. The head 15 is actuatable to insert a stitch through the stacked layers 12. A detector 16 is provided to sense the movement of stack 12 across surface 14. Control circuitry 18 responds to increments of stack movement to actuate the head 15.

Figure 2:
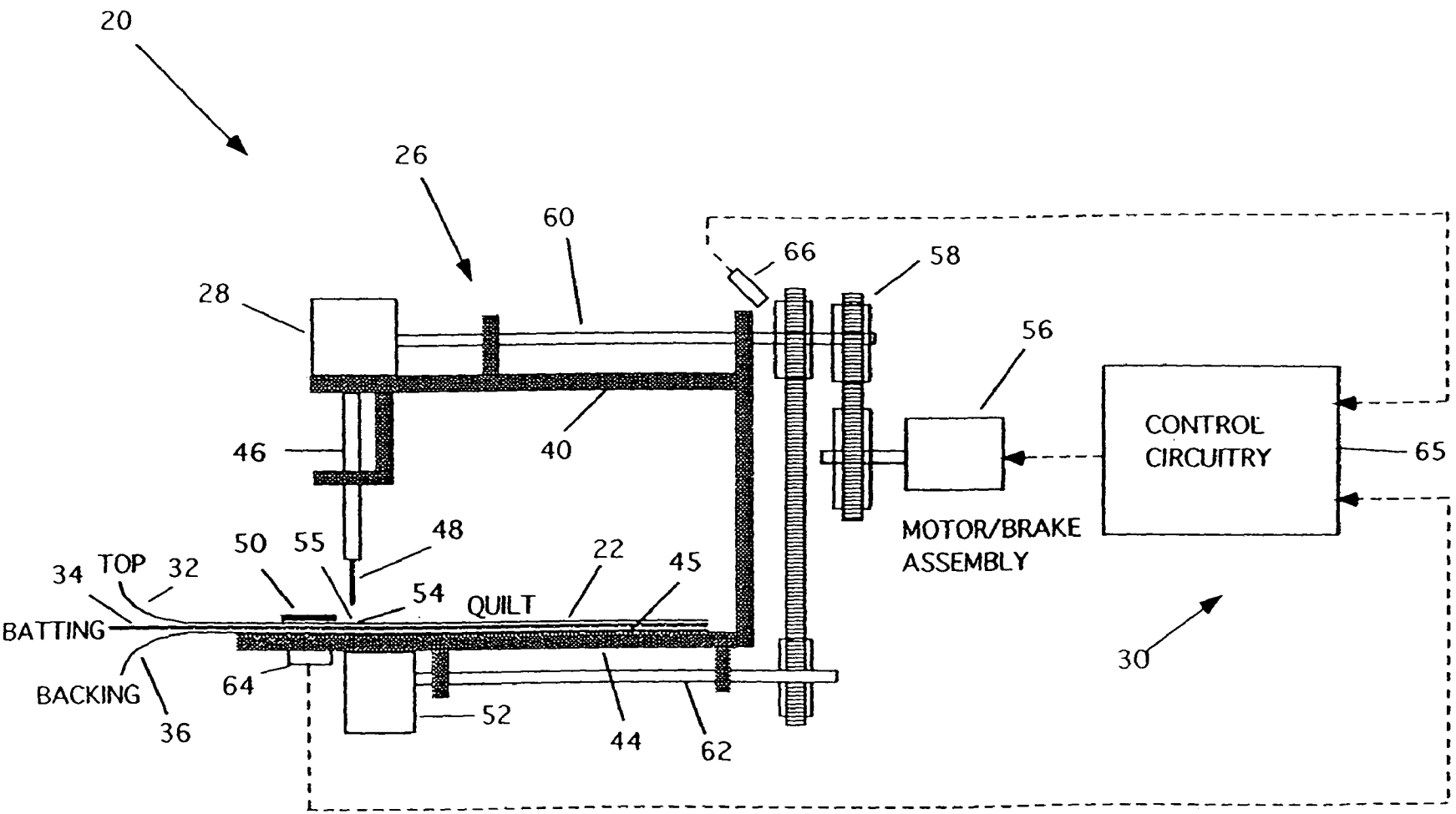

FIG. 2 illustrates an exemplary embodiment 20 of the system of FIG. 1 for stitching together fabric layers of a stack 22. The embodiment 20 is generally comprised of a mechanical machine portion 26, including an actuatable stitch head 28, and an electronic control subsystem 30 for actuating the head 28 in response to movement of the stack 22. The stack 22 is typically comprised of multiple fabric layers, e.g., a top layer 32, an intermediate batting layer 34, and a bottom backing layer 36, which when stitched together will form a quilt.

The machine portion 26 of FIG. 2 is depicted as including a machine frame 40 configured to support the stitch head 28 above a bed 44 providing a substantially horizontally oriented planar surface 45. The stitch head 28 includes a needle arm 46 supporting a needle 48 for reciprocal or cyclic vertical movement essentially perpendicular to the planar surface 45. The bed surface 45 is configured for supporting the layered stack 22 so as to enable a user to guide the stack 22 across the surface 45 by manual push-pull action. A hold-down plate, or presser foot, 50 is preferably provided to selectively press the stack 22 against the bed surface to assure proper stitch tension and to assist the needle to pull upwardly out of the stack after inserting a stitch.

Figure 4:
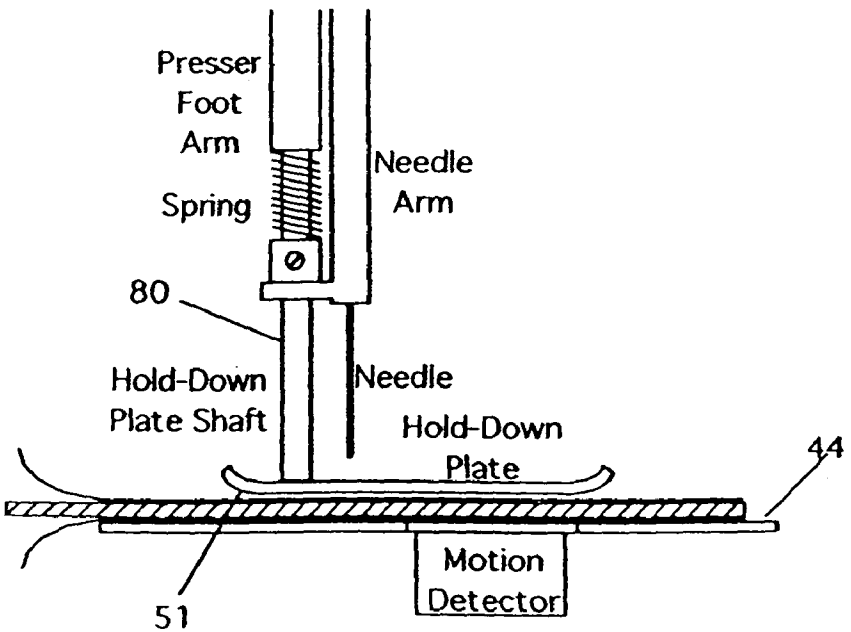

A conventional hook and bobbin assembly 52 is mounted beneath the bed 44 in alignment with the needle 48. The needle 48 operates in a conventional manner in conjunction with the hook and bobbin assembly 52 to insert a stitch through the stack 22 at a stitch site 54, i.e., an opening 55 in bed 44. When the needle 48 is lowered to its down position to pierce the stack layers (FIG. 3), the hold-down plate 50 is also lowered to press the stack layers against the bed 44 to achieve proper stitch tension and assist the needle to pull up out of the stack. After completion of a stitch cycle, the needle 48 and hold-down plate 50 are raised (FIG. 4).

The machine portion 26 of FIG. 2 is further depicted as including a motor/brake assembly 56 which functions to selectively provide operating power and braking via a suitable transmission system 58 to an upper drive shaft 60 and a lower drive shaft 62. The upper drive shaft 60 transfers power from the motor/brake assembly 56 to stitch head 28 for moving the needle 48. The lower drive shaft 62 transfers power from the motor/brake assembly 56 to the hook and bobbin assembly 52.

Figure 8:
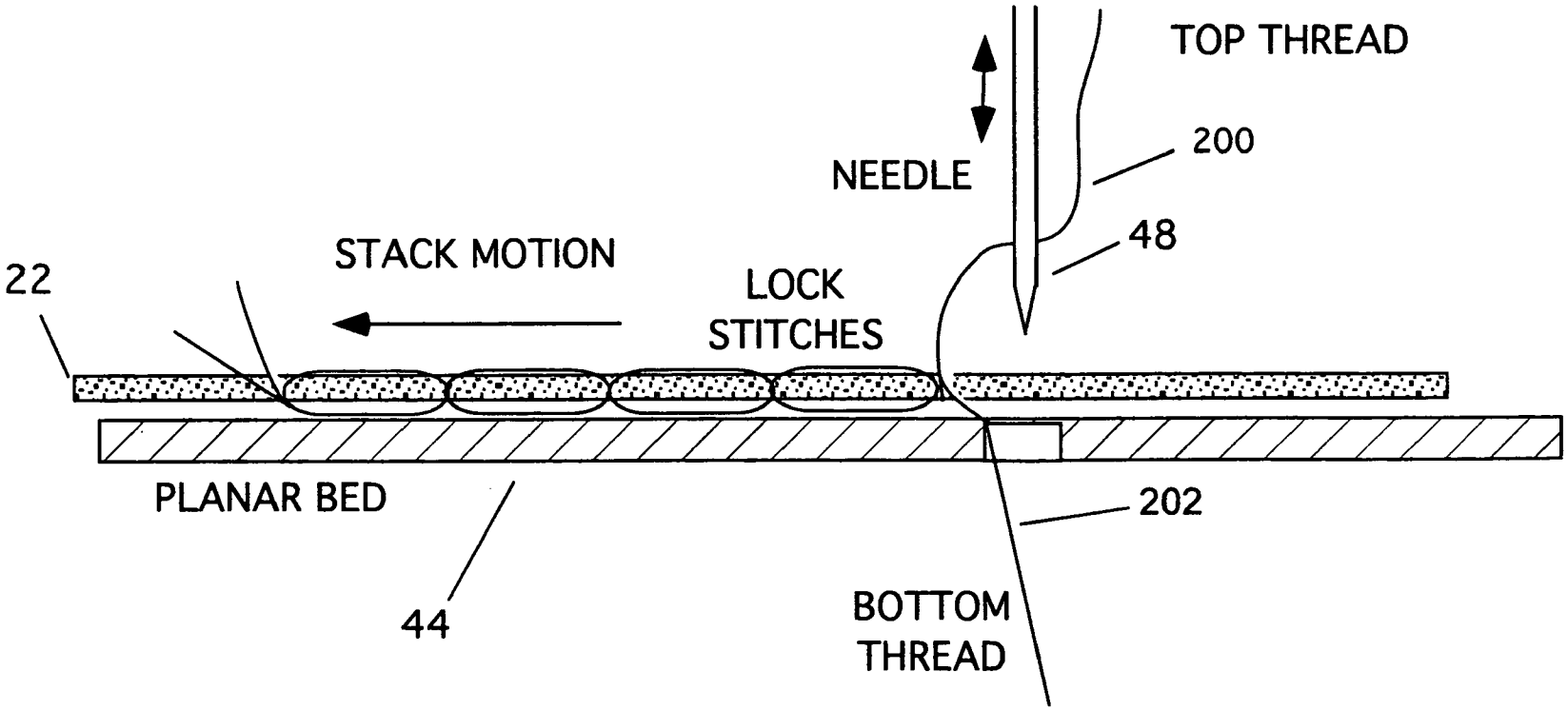
FIG. 8 is a generalized schematic diagram showing how top and bottom threads cooperate to form a conventional lock stitch.

The stitch head 28 and hook and bobbin assembly 52 operate cooperatively in a conventional manner to insert stitches through stack 22 at stitch site 54. That is, when the stitch head cycle is initiated, needle 48 is driven downwardly to pierce the stacked layers 32, 34, 36 and carry a top thread paid out through the needle through the stitch site opening 55 in bed 44. Beneath the bed 44, the hook (not shown) of assembly 52 grabs a loop of top thread 200 before the needle 48 pulls it back up through the stack. The top thread 200 loop grabbed by the hook is then looped around the bottom thread 202 pulled off the assembly 52 to lock the top and bottom threads together to form a lock stitch as illustrated in FIG. 8.

The system of FIG. 2 includes a transducer, or detector, 64 for detecting the movement, or more specifically, the translation of the stack 22 on bed 44 for the purpose of controlling the motor/brake assembly 56 via control circuitry 65. In operation, a user is able to freely move the stack 22 on bed 44 relative to the stitch head 28 while the detector 64 produces electronic signals representative of the stack movement. Control circuitry 65 then responds to the detected stack movement for controlling the issuance of a stitch from head 28. The control subsystem 30, in addition to including motion detector 64 and control circuitry 65, may also include a shaft position sensor 66. The shaft position sensor 66 functions to sense the particular rotational position of the upper drive shaft 60 corresponding to the needle 48 being in its full up position. The control circuitry 65 preferably responds to the output of sensor 66 to park the needle 48 in its full up position between successive stitch cycles. This action prevents the needle from interfering with the free translational movement of the stack 22 on bed 44.

In typical use of the apparatus of FIG. 2, an operator manually guides the fabric stack across the horizontally oriented bed 44 beneath the vertically oriented needle 48. The motion detector 64 is mounted to monitor a target area coincident with a surface layer (top and/or bottom) of the stack 22 as the stack is moved across the bed 44.

Although the motion detector 64 of FIG. 2 can take many different forms, including both noncontacting devices (e.g., optical detector) and contacting devices (e.g., track ball), it is preferred that it detect stack movement without physically contacting the fabric layers. Accordingly, a preferred motion detector 64, as discussed in said '355 application, comprises an optical motion detector utilizing, for example, an optical chip ADNS2051 marketed by Agilent Technologies.

Figure 3:
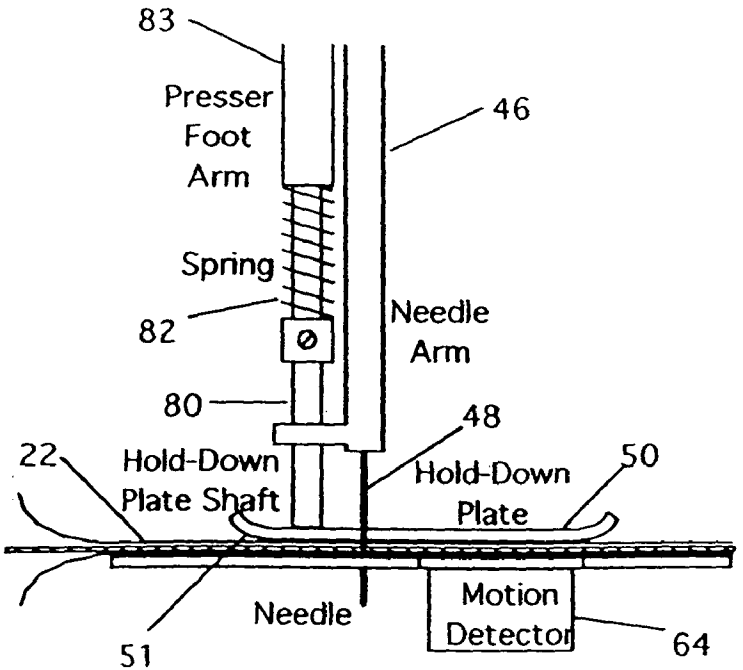

Suffice it to say that the accurate measurement of stack movement in FIG. 2, depends, in part, upon the stack target layer, e.g., backing layer 36, being positioned near the focus of the motion detector window. The aforementioned hold-down plate or presser foot 50 assists in maintaining the stack layers at a certain distance from the detector window. The hold-down plate 50 preferably has a flat smooth bottom surface 51 for engaging the stack 22 and is fabricated of transparent material to avoid obstructing a user's view of the stack layers proximate to the needle 48. FIGS. 3 and 4 respectively illustrate the actuated and non actuated positions of the hold-down plate 50. In FIG. 3, shaft 80 is moved down during the stitch cycle to cause the plate 50 to apply spring pressure, attributable to spring 82, to the stack 22. Between cycles (FIG. 4), shaft 80 is moved up so the pressure of plate 50 against stack 22 is relieved to reduce motion-inhibiting friction of the plate against the stack. Nevertheless, during a non-stitch interval between cycles, the plate 50 is positioned closely enough to loosely hold the stack against the bed 44.

Figure 5:
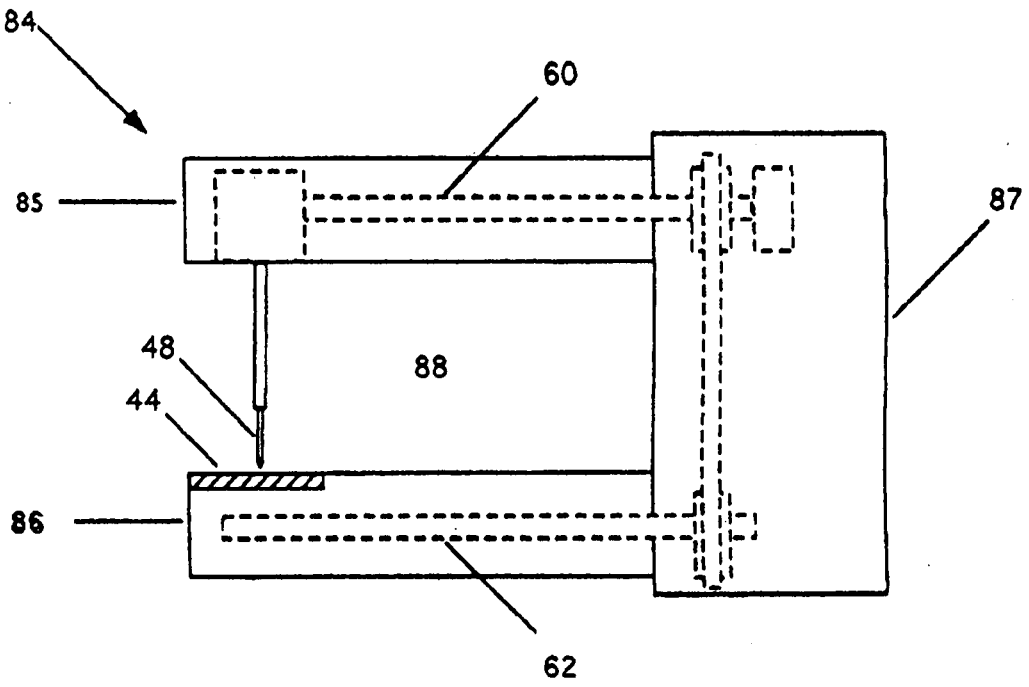
Figure 6:
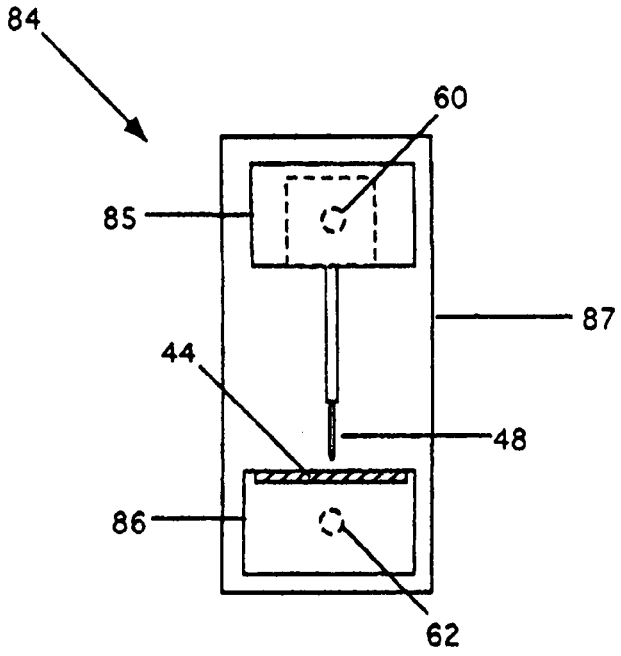

FIGS. 5 and 6 schematically depict a typical quilting/sewing machine housing 84 for accommodating the physical components of the system of FIG. 2. The housing 84 comprises an upper arm 85 which contains the upper drive shaft 60 and a lower arm 86 containing the lower drive shaft 62. The housing upper and lower arms 85 and 86 extend from a vertically oriented machine arm 87. The upper and lower arms 85, 86 are vertically spaced from one another and together with the machine arm 87 define a space which is generally referred to as the throat space 88. The needle 48 descends vertically from the upper arm into the throat space 88 for reciprocal movement toward and away from the lower arm 85. The lower arm 85 carries the bed 44 which is sometimes referred to as the throat plate. The distance between the needle and the machine arm is generally referred to as the throat length.

Figure 7:
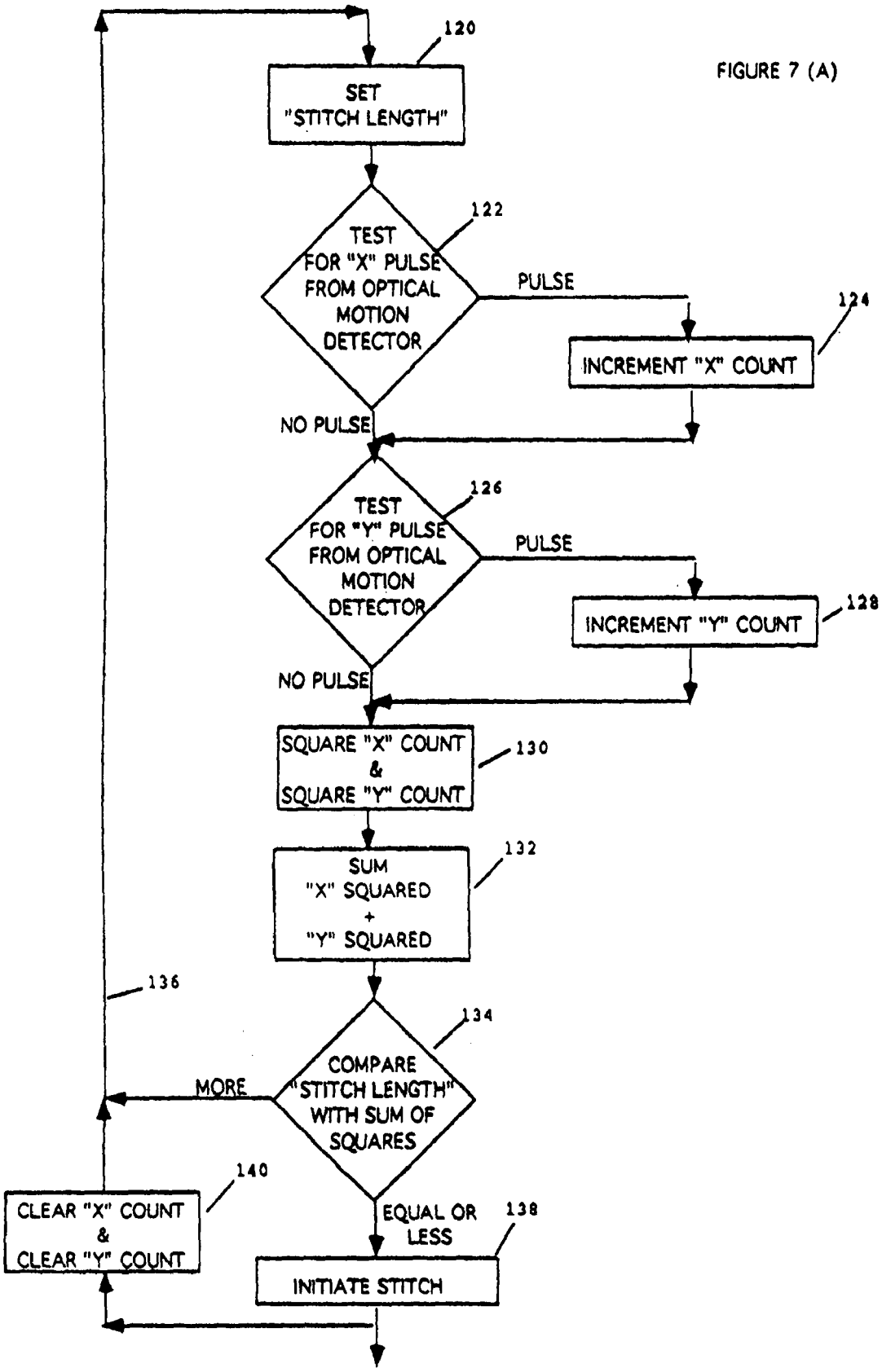

Attention is now directed to FIG. 7(A, B) which comprises a flow diagram depicting an exemplary algorithmic operation of a microcontroller for controlling the motor/brake assembly 56 of FIG. 2. In FIG. 7, first note block 120 which functions to initialize a stitch cycle by acquiring a "stitch length" value which typically was previously entered via a user input. With the stitch length value set in block 120, the algorithm proceeds to decision block 122 which tests for stack translation in the X direction, i.e., for an X pulse on lead 96 from the optical chip 95. If a pulse is detected, then a store X count is incremented, as represented by block 124. After execution of blocks 122, 124, operation proceeds to decision block 126 which tests for Y translation, i.e., for a Y pulse out of the detector 64. If a Y pulse is detected, then a stored Y count is incremented as represented by block 128. Operation then proceeds from blocks 126 or 128 to block 130. Blocks 130 and 132 essentially represent steps for determining the resultant stack movement magnitude attributable to the measured X and Y components of motion utilizing the Pythagorean theorem. That is, in block 130, the X count value is squared and the Y count value is squared. Block 132 sums the squared values calculated in block 130 to produce a value representative of the resultant stack movement Block 134 compares the square of the preset switch length value with the magnitude derived from block 132. If the magnitude of the resultant movement is less than the preset stitch length, then operation cycles back via loop 136 to the initial block 120. If on the other hand, the resultant magnitude exceeds the preset stitch length, then operation proceeds to block 138 to initiate a stitch. In block 140, the X and Y counts are cleared before returning to the initial block 120.

FIG. 7(A) as discussed thus far relates primarily to operation in the impulse, or single stitch, mode. FIG. 7B depicts dual mode operation, i.e., impulse mode at slow stack speeds and a continuous proportional mode at higher stack speeds. It is preferable to provide such a dual mode capability to be able to operate more smoothly at higher stack speeds. By way of explanation, it will be recalled that in order to accommodate slow stack speed operation, e.g., less than 20 inches per minute, it is desirable that each stitch command initiate a very rapid needle stroke to avoid the needle interfering with stack movement. As the stack translation speed and needle stroke rate increase, the needle's interference with stack movement diminishes. Thus, at fast stack speeds, e.g., greater than 20 inches per minute (or 200 stitches per minute assuming an exemplary 0.1 inch stitch length), it is appropriate to switch to a proportional mode in which the needle is continuously driven at a rate substantially proportional to the speed of stack translation. At a speed of 200 stitches per minute, each needle cycle consumes less than about 300 milliseconds. Accordingly, the algorithm depicted in FIG. 7(B) includes a step which tests for the time duration between successive stitch commands, i.e., a stitch time interval. If the duration of this interval is less than an exemplary 300 milliseconds, then operation proceeds in the proportional mode. FIG. 7(B) shows that block 138 is followed by block 152 which reads and resets a stitch interval timer (which can be readily implemented by a suitable microcontroller) which times the duration between successive stitch commands and records the angular position $\theta_n$ of the needle drive shaft 60 (block 153). Decision block 154 then tests the interval timer duration previously read in block 152 to determine whether it is greater than the aforementioned exemplary 300 millisecond interval. If yes, operation proceeds to the impulse mode 155. If no, operation proceeds to the proportional mode 156.

Operation in the impulse mode 155 involves block 157 which is executed to assure deactivation of the proportional mode. Thereafter, block 148 is executed which involves waiting for a signal from the bobbin hook sensor. The motor (or clutch) is then actuated in block 142 and actuation terminates when a terminating pulse is recognized from the shaft position sensor (block 146). Block 158 then deactuates a motor/clutch relay and/or actuates a brake after a stitch recognized in block 146 to park the needle in its up position.

Operation in the proportional mode 156 includes step 159 which activates motor speed control operation. A motor speed control capability is a common feature of most modern sewing machines with motor speed being controlled by the user, e.g., via a foot pedal, and/or by built-in electronic control circuitry.

After block 159, decision block 160 is executed. To understand the function of decision block 160, it must first be recognized that as stack speed is increased, thus generating shorter duration stitch intervals, the shaft angle position $\theta_n$ read in block 153 will decrease, in the absence of an adjustment of motor/needle shaft speed. In other words, a newly read shaft angle $\theta_n$ will be smaller than a previously read shaft angle $\theta_p$. Block 160 functions to compare $\theta_n$ and $\theta_p$ if stack speed increases. If $\theta_n$ is smaller, the motor speed must be increased (block 161) to deliver stitches at an increased rate to maintain stitch length uniformity.

On the other hand, if stack speed is reduced so that $\theta_n$ is greater than $\theta_n$, motor speed is decreased (block 162) in order to produce uniform length stitches. If stack speed remains constant, then $\theta_n$ equals $\theta_p$ and no motor sped adjustment is called for (block 163).

The embodiments discussed thus far (FIGS. 1-7) contemplate use of a motion detector 64 for observing energy reflected from the top and/or bottom stack surfaces to produce signals representing stack translation along X and Y axes. A microcontroller functions to resolve these X and Y components to determine the magnitude of stack translation for controlling stitch head actuation as explained by FIG. 7. As is well known, most modern sewing machines employ the aforementioned "lock stitch" stitching technique. This involves use of a top thread 200 and a bottom thread 202 (FIG.

8) respectively supplied from separate sources, e.g., bobbins, or spools. In operation, the needle executes successive cyclic movements where each cycle involves the needle moving from a needle-up position to a needle-down position piercing the stack and then returning to the needle-up position. When the needle pierces the stack, it pulls a loop of top thread down through the stack. The top thread loop is grabbed by a shuttle hook beneath the planar bed and then looped around the bottom thread to form a single lock stitch.

Applicants parent application Ser. No. 11/443,563 describes a method and apparatus for controlling stitch head actuation as a function of stack movement based on the recognition that thread is pulled, or paid out, from a top or bottom supply source in direct relationship to the movement of the stack. By detecting the length of thread payout, control circuitry can respond to control the rate of stitch head actuation. As a consequence, uniform length stitches can be produced as the stack is freely manually guided across the planar bed.

Figure 9:
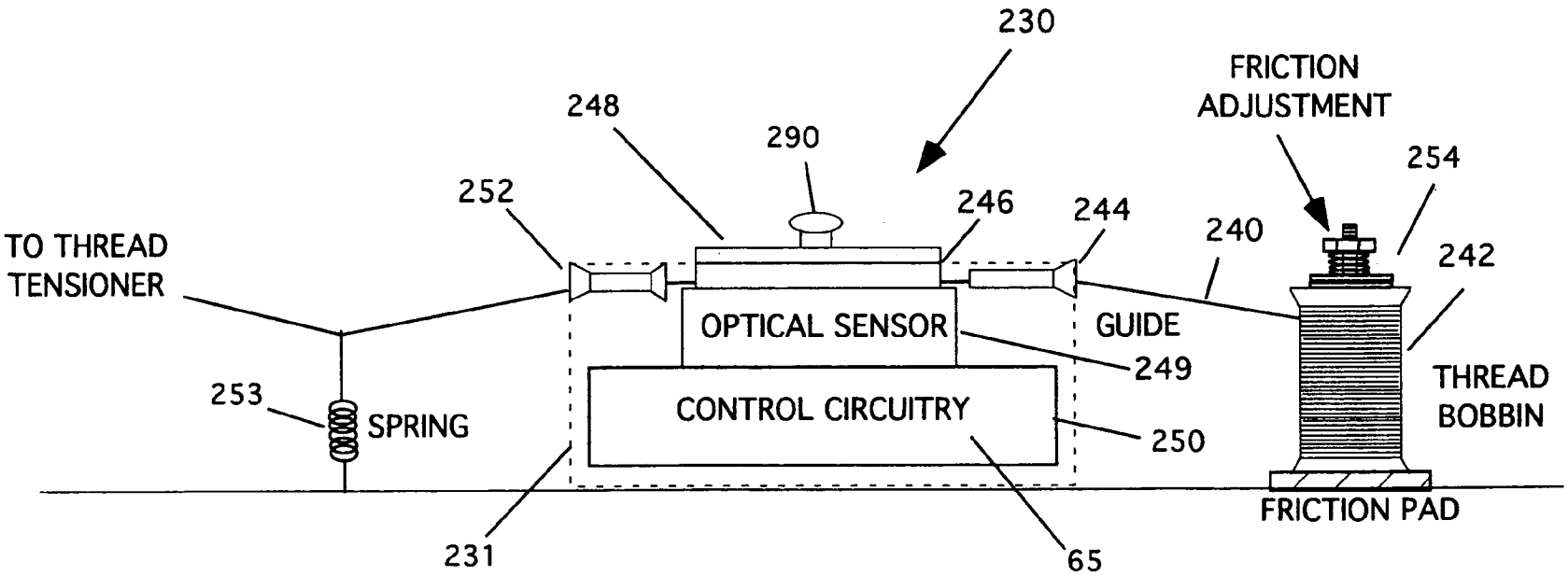
FIG. 9 is a schematic side view of a preferred thread movement detector in accordance with the present invention.

The present application is directed to a preferred apparatus 230 (FIG. 9) including a housing 231 for detecting the longitudinal movement of thread 240 paid out from a thread source. More particularly, FIG. 9 illustrates thread 240 being paid out from a top thread bobbin 242. From the bobbin 242, the thread 240 enters an upstream entrance 244 of guide path 246, passes through a detector module 248 which includes a compartment 249 housing an optical sensor, and emerges at a downstream guide path exit 252. From the exit 252, the thread 240 moves toward a conventional thread tensioner (not shown) and the stitch head needle. Means are preferably provided for maintaining tension on the thread 240 along the guide path 246. Accordingly, a tension spring 253 is preferably coupled to the thread 240 downstream of the exit 252. Also, a friction mechanism 254, which may include a friction pad, a pressure plate, and an adjustable nut, is preferably associated with the supply spool 242 to provide a small amount of rotational drag. In addition to the optical sensor compartment 249, the housing 231 also includes a compartment 255 for housing control circuitry 65.

Figure 10:
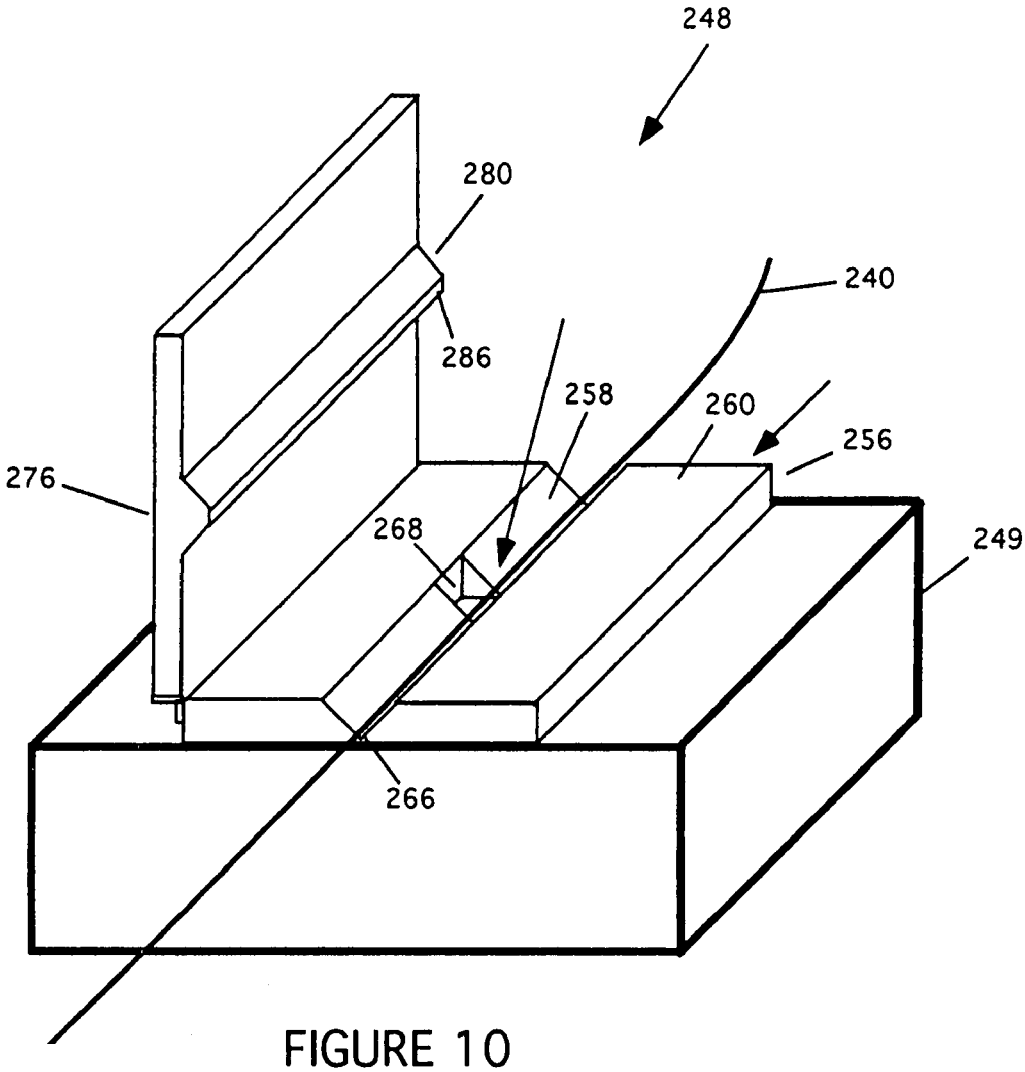
FIG. 10 is an isometric view of a preferred detector module for use in the detector of FIG. 9.
Figure 13:
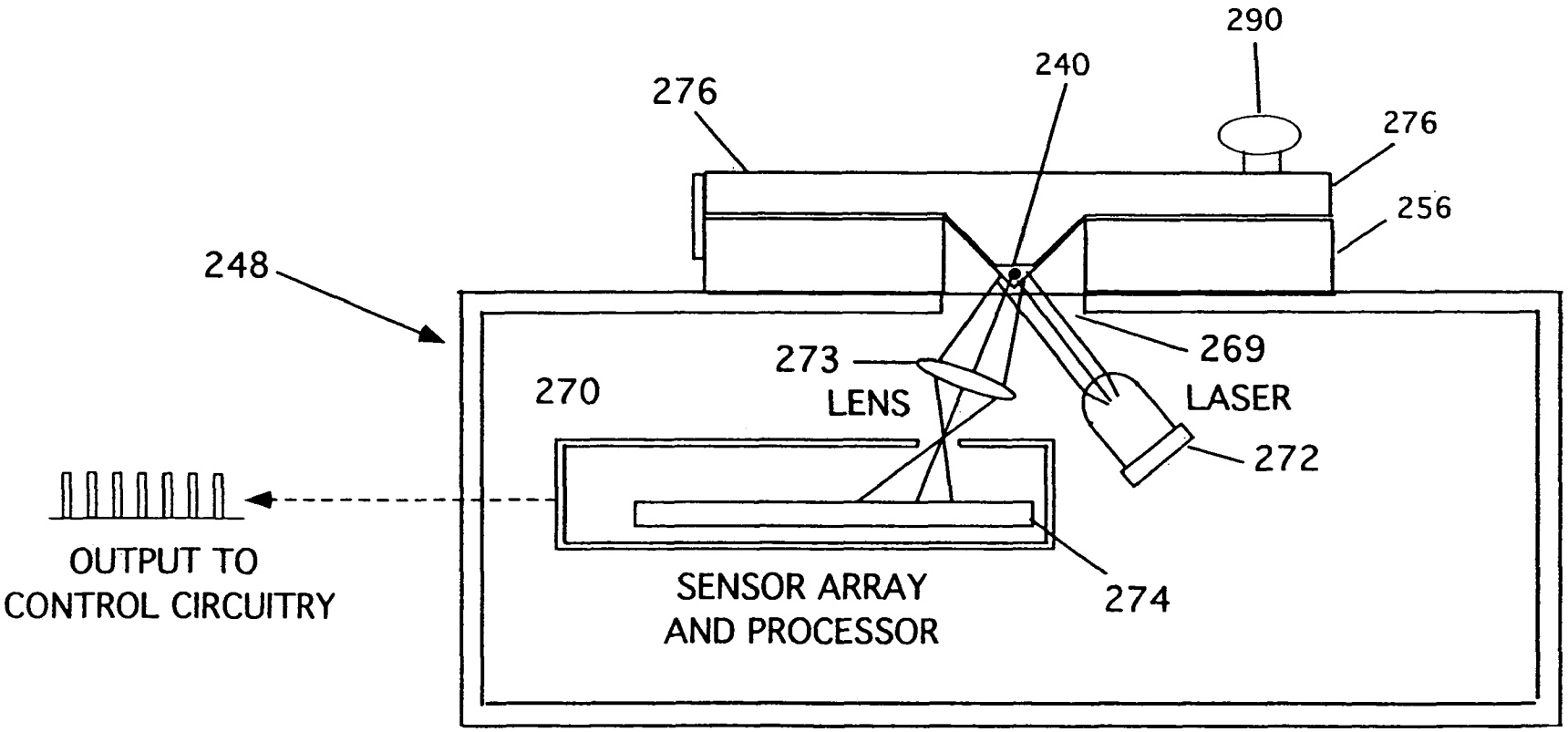
FIG. 13 is a schematic end view of the detector module of FIG. 10 showing the mounting of a light source and optical sensor relative to a thread guide path.
Figure 14:
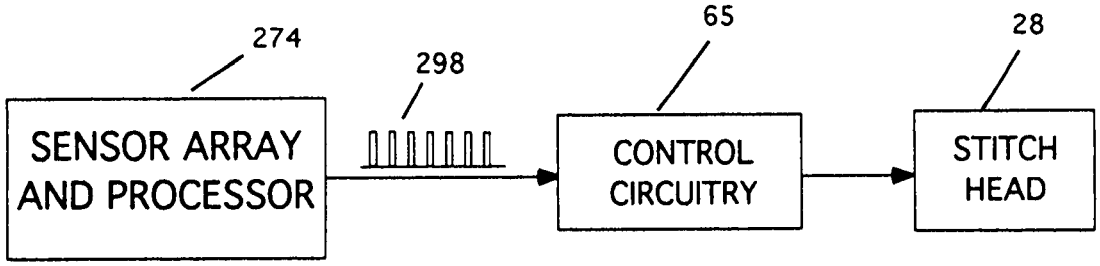
FIG. 14 is a schematic block diagram showing the sensor and processor of FIG. 11 connected to control circuitry for controlling the stitch head.

A preferred detector module 248 is illustrated in FIGS. 10-13. The detector module 248 is comprised of a base plate 256 having an elongate channel 258 extending into the base plate from surface 260 (FIG. 10). The channel 258 is preferably V-shaped in cross-section, defined by oblique side walls 262 and 264 (FIG. 11) which converge at a vertex 266. A light transmissive window 268 is formed in the channel walls adjacent to the vertex 266. A slot 269 is provided beneath the base plate adjacent to the window 268 to pass light into the compartment 249 housing a light source 272, a lens 273, and an optical sensor 274 (FIG. 13).

Figure 11:
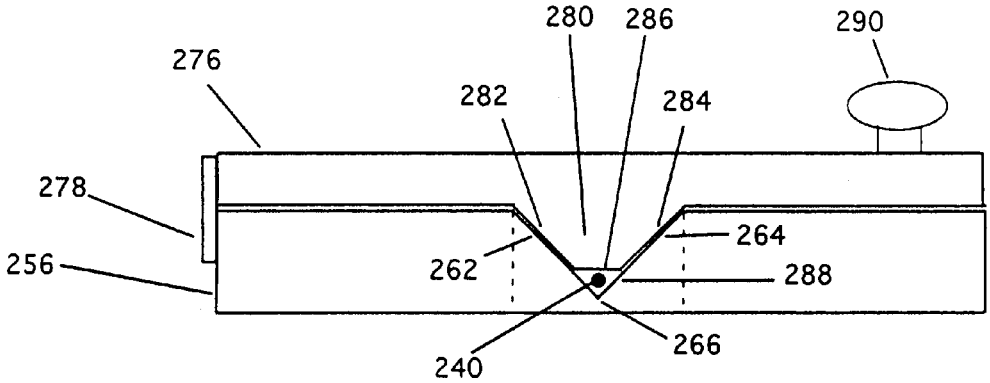
FIG. 11 is an enlarged end view of the portion of the detector module of FIG. 10 forming a passageway for longitudinal movement of the thread.
Figure 12:
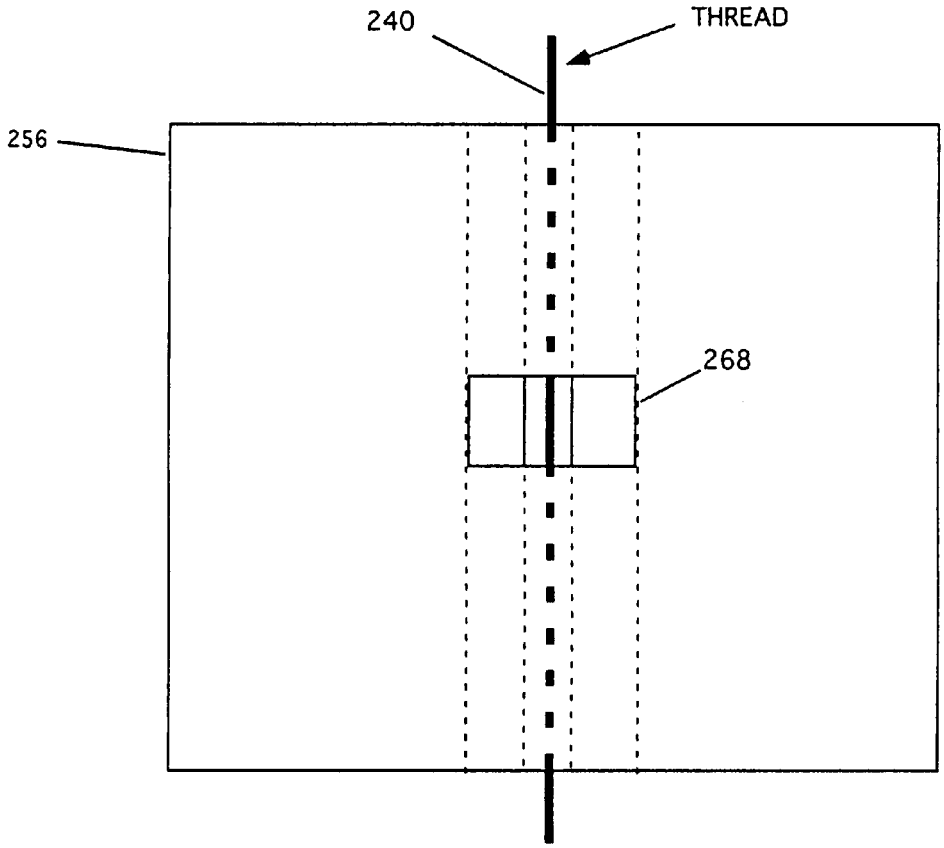
FIG. 12 is a bottom view of the detector module portion of FIG. 11.

The preferred detector module 248 also includes a hold-down plate 276 which is coupled to the base plate 256 by hinge 278. The hold-down plate 276 carries an elongate protuberance 280 having oblique side walls 282 and 284 which are preferably truncated at surface 286. FIG. 10 illustrates the hold-down plate 276 in its open position which allows a user to readily insert thread 240 through guide entrance 244, channel 258, and guide exit 252. FIG. 11 illustrates the hold-down plate 276 in its closed position with protuberance 280 extending into channel 258. Note that surface 286 in FIG. 11 is spaced from the vertex 266 to define a small elongate passageway 288. A suitable clamp, e.g., thumb screw 290, can be provided to clamp hold-down plate 276 against base plate 256 to retain the protuberance 280 nested in channel 258. The passageway 288 is preferably dimensioned to allow the thread 240 to readily move longitudinally therethrough while maintaining the thread close to the focus of the lens 273 and optical sensor 274.

The light source 272 is mounted to illuminate thread 240 through window 268 to produce reflections from the thread back through the window 268 and slot 269 onto optical sensor 274, via a suitable focusing lens 273. Although the optical sensor can take various forms, one particularly suitable commercially available sensor is marketed as the ADNS-6030 by Avago Technologies and includes a sensor array and digital processor. A compatible laser light source is marketed as the ADNV-6330 and a compatible focusing lens as the ADNS-6120 or 6130. In order to optimize the ability of the sensor to detect the movement of thread 240, the sensor and lens should be mounted so that the passageway vertex 266 is located close to the focus of the sensor 274 as established by lens 273.

The sensor 274 array and processor function to monitor target movement, i.e., thread movement, to produce an output pulse 298 for each predetermined increment of movement. In use, as a user moves the stack 22 across the planar bed 44, a train of pulses is produced which is coupled to control circuitry 65 (FIG. 14), of the type previously discussed with respect to FIGS. 1-7, for controlling the actuation of the stitch head 28.

From the foregoing, it should now be appreciated that a stitch head (e.g., 28 in FIG. 2) can be controlled in response to the detected length of thread payout to produce stitches of uniform length in a fabric stack manually guided beneath the stitch head. The control can be exercised in either an impulse mode or a proportional mode or a dual mode system. It should be understood from the prior discussion that operation in the impulse mode produces a single stitch for each threshold unit of stack movement, i.e., each unit of longitudinal thread payout. In the proportional mode, the needle cycles at a rate proportional to the rate of stack movement, i.e., the rate of thread payout. Dual mode operation contemplates use of the impulse mode at slow stack speeds and the proportional mode at higher stack speeds. It should also be understood that although it is preferable to incorporate thread payout detection as an integral part of a sewing/quilting machine, it is recognized that an existing conventional sewing machine can be modified, or retrofitted, to incorporate this function by exercising control of the stitch head via the normal food pedal input in the manner shown in FIG. 16 of Applicant's aforementioned U.S. Pat. No. 6,883,446.

In a typical quilting/sewing machine, it is intended that top and bottom threads pay out at the same rate. In the actual use of such a sewing machine, the top and bottom threads can sometimes pay out at different rates for various reasons, resulting in the formation of inferior stitches. For example, if the tension on the top thread is too great, the bottom thread can be pulled through the stack and be visible on the stack top surface. On the other hand, if the top thread tension is insufficient, the top thread can be visible on the stack bottom surface. In order to avoid such inferior stitches, sewing machines typically include mechanisms enabling a user to manually adjust top and bottom thread tension. By measuring both top and bottom thread movement in accordance with the present invention, any disparity in the respective movements can be recognized and used to automatically adjust the tension of one or both threads to restore stitch quality.

The invention claimed is:

1. A machine for stitching at least one fabric layer, said machine comprising:

an upper arm and a lower arm mounted in vertically spaced substantially parallel relationship to define a throat space therebetween;

a substantially horizontally oriented plate mounted proximate to said lower arm for supporting said fabric layer for guided movement in said throat space;

a needle arm supported from said upper arm actuatable to reciprocally move a needle substantially perpendicular to said plate for piercing said fabric layer with a top thread paid out from a top thread supply source;

means for paying out a bottom thread from a bottom thread supply source for forming a lock stitch with said top thread each time said fabric layer is pierced by said needle;

guide means for guiding one of said threads for longitudinal movement along a defined path;

detector means including an optical sensor mounted proximate to said path for producing an output signal representative of longitudinal thread movement along said path; and control means responsive to said output signal for actuating said needle arm at a rate related to the rate of longitudinal thread movement along said path.

2. The machine of claim 1 wherein said detector means includes a light source for illuminating a thread on said path; and a lens for focusing light reflected from said illuminated thread onto said optical sensor.

3. The machine of claim 2 wherein said light source comprises a laser.

4. The machine of claim 1 wherein said guide means includes a channel defining said path.

5. The machine of claim 1 wherein said guide means includes first and second elongate oblique walls converging at a vertex to form a V-shaped channel defining said path; and a light transmissive window formed in said channel.

6. The machine of claim 5 further including an elongate V-shaped protuberance configured to nest in said channel to form a passageway therebetween for accommodating said thread for longitudinal movement along said passageway.

7. A method of forming successive stitches in a stack of one or more fabric layers, said method comprising;

providing a horizontally oriented planar surface for supporting said stack for guided movement across said planar surface;

causing a needle mounted above said planar surface to execute successive cyclic movements, each cyclic movement including a needle-up position above said planar surface and a needle-down position piercing said stack and delivering an increment of top thread beneath said planar surface paid out from a top thread source;

causing each top thread increment delivered beneath said planar surface to form a stitch with an increment of bottom thread paid out from a bottom thread source;

detecting the rate of thread payout from at least one of said thread sources; and causing said needle to execute said cyclic movements at a rate related to said detected rate of thread payout.

8. The method of claim 7 wherein said detecting step includes illuminating at least one of said threads and sensing reflections from said illuminated thread.

9. The method of claim 7 wherein said detecting step includes guiding at least one of said threads for longitudinal movement along a defined path, illuminating said guided thread on said path, and optically sensing light reflected from said illuminated thread.

* * * * *